US005398570A

United States Patent [19]

Chae

[11] Patent Number: 5,398,570

[45] Date of Patent: Mar. 21, 1995

[54] SUPPLEMENTARY DEVICE FOR A VEHICLE PEDAL

[76] Inventor: Jong-Chun Chae, 438-18, Shinwon-dong, Seocho-gu, Seoul, Rep. of Korea

[21] Appl. No.: 132,045

[22] Filed: Oct. 5, 1993

[30] Foreign Application Priority Data

| | | | |
|---|---|---|---|
| Oct. 8, 1992 | [KR] | Rep. of Korea | 19305/1992 |
| Oct. 12, 1992 | [KR] | Rep. of Korea | 19539/1992 |
| Nov. 14, 1992 | [KR] | Rep. of Korea | 22448/1992 |
| Feb. 23, 1993 | [KR] | Rep. of Korea | 2473/1993 |
| Sep. 20, 1993 | [KR] | Rep. of Korea | 18910/1993 |

[51] Int. Cl.[6] ..... G05G 1/16

[52] U.S. Cl. ..... 74/563; 74/560; 74/594.4; 280/259

[58] Field of Search ..... 74/560, 594.4, 594.6, 74/563, 558.5; 280/259; 36/131; 403/256, 258, 260, 261; 24/324, 514, 525

[56] References Cited

U.S. PATENT DOCUMENTS

| | | | |
|---|---|---|---|
| 1,001,504 | 8/1911 | Cary | 74/563 |
| 1,292,760 | 1/1919 | Grant | 74/563 |
| 1,297,202 | 3/1919 | McGiehan | 74/563 |
| 1,455,675 | 5/1923 | Sinclair | 74/563 |
| 2,668,458 | 2/1954 | Russell | 74/563 |

FOREIGN PATENT DOCUMENTS

| | | |
|---|---|---|
| 84-7152 | 12/1984 | Rep. of Korea . |
| 84-7153 | 12/1984 | Rep. of Korea . |
| 91-11387 | 7/1991 | Rep. of Korea . |

*Primary Examiner*—Charles A. Marmor
*Assistant Examiner*—Troy Grabow
*Attorney, Agent, or Firm*—Albert C. Smith

[57] ABSTRACT

A supplementary device for vehicle pedal comprising an upper pedal piece having an open hole and a screw hole, a lower supporter having a slot on one end and a screw hole on the other end, and a locking plate located at the bottom of the lower supporter. Each end of the upper pedal piece and the locking plate are screwed, the slot of the lower supporter is inserted between the assembly, and the assembly is tightly screwed by bolts.

5 Claims, 14 Drawing Sheets

SUPPLEMENTARY DEVICE FOR A VEHICLE PEDAL

BACKGROUND OF THE INVENTION

This invention relates to a supplementary device for a vehicle pedal, the vehicle being, for example an automobile, a motorcycle, a farming machine and the like, especially to a supplementary device of a break pedal, a clutch pedal, and an acceleration pedal which is convenient to assemble.

Vehicle pedals are formed in a somewhat small size and they are impossible to replace. When one quickly steps on the pedal in case of emergency, the foot often slips off the pedal, which may give rise to an accident, especially during rain or in the winter.

For this reason, a supplementary device for a pedal, which is detachable and somewhat larger sized, has been used.

The prior supplementary device for a pedal is composed of an upper pedal piece attached to the pedal, a lower supporter attached to the bottom of the pedal, and a locking plate attached at the bottom of said lower supporter. Said attachments are attached to the vehicle pedal by screws.

However, assembly of the prior supplementary device is very difficult because said attachments should be aligned in one row and a plurality of bolts must be screwed in a narrow space. And, there are problems such as the assembly may be loosened due to the motion of the vehicle.

SUMMARY OF THE INVENTION

The object of this invention is to provide a supplementary device for a pedal being convenient to assemble, and firmly assembled.

This object and other features will be made apparent from the following description, given by way of purely explanatory and by no means limitative example, in conjunction with the drawings herein.

BRIEF DESCRIPTION OF THE INVENTION

DESCRIPTION OF THE PREFERRED EMBODIMENT

Figure 1:
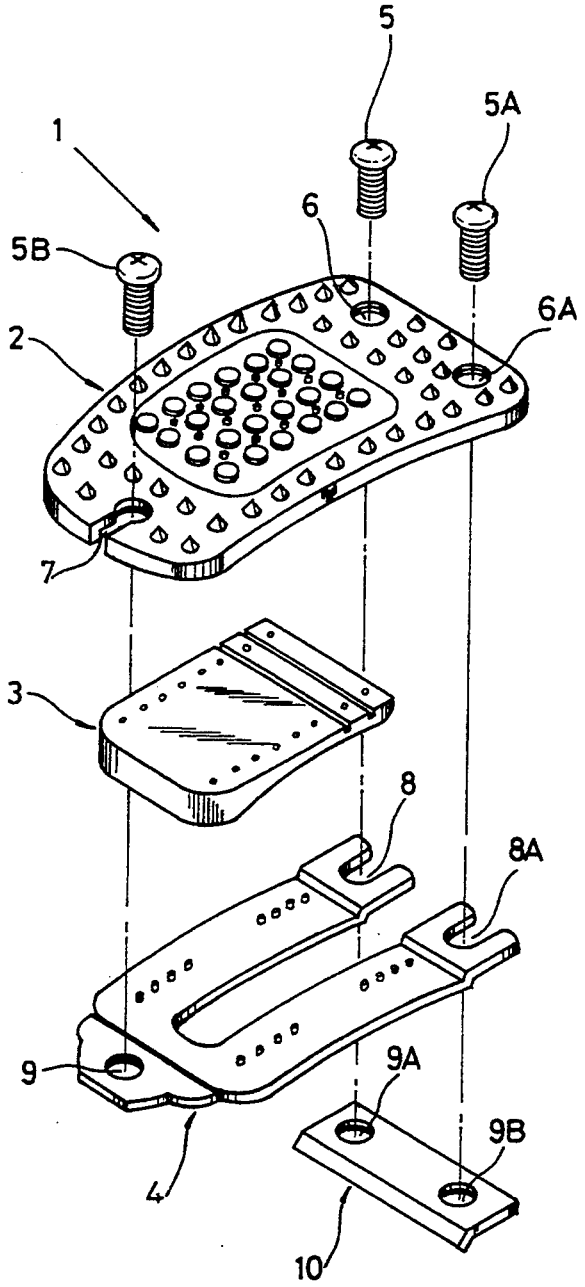
FIG. 1 is an exploded view of a supplementary device of pedal in accordance with the present invention.
Figure 2:
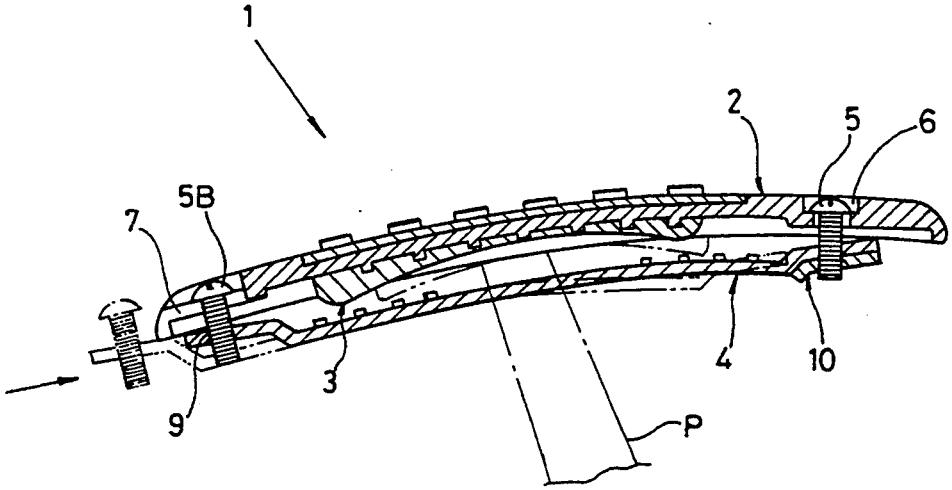
FIG. 2 is a side view showing the assembled condition of the present invention.
Figure 3:
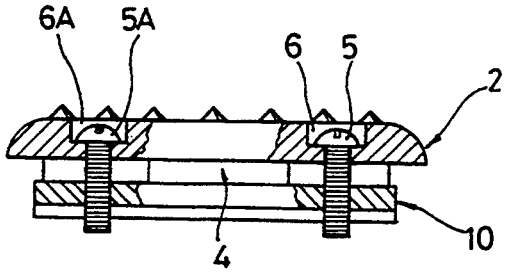
FIG. 3 is a front view of FIG. 2.

Referring to FIG. 1 to FIG. 3, the present device is composed of three members, that is, an upper pedal piece 2, a lower supporter 4, and a locking plate 10. In the present invention, the essential member is the lower supporter. Every example described hereinafter is primarily related to said lower supporter construction.

The upper pedal piece 2 has two screw holes 6, 6A and one open screw hole 7.

The lower supporter 4 is an angled plate having two slots 8, 8A at its front and a screw hole 9 at the other end. Under the lower supporter, the locking plate 10 having two screw holes 9A, 9B is assembled. A rubber plate 3 is provided between the bottom of the upper pedal piece 2 and the upper surface of pedal 9 to secure the assembly.

Hereinafter an assembly method will be explained.

Two bolts 5, 5A are partially screwed through the screw holes 6, 6A of the upper pedal piece 2 into the screw holes 9A, 9B of the locking plate 10. A rubber plate 3 is inserted between the bottom of upper pedal piece 2 and the upper surface of pedal P. The open screw hole 7 of the upper pedal piece 2 and the screw hole 9 of the lower supporter 4 are aligned and bolt 5B is partially screwed. Then, the two bolts 5, 5A are inserted to the two slots 8, 8A of the lower supporter 4 as shown in FIG. 2. Finally, the bolts 5, 5A, 5B are tightly screwed.

In accordance with said example, as one end (the front end) of lower supporter 4 is not directly screwed but inserted to the bolting assembly of the upper pedal 2 and the locking plate 10, the assembling work is done very easily and the assembly is very tight.

Figure 4:
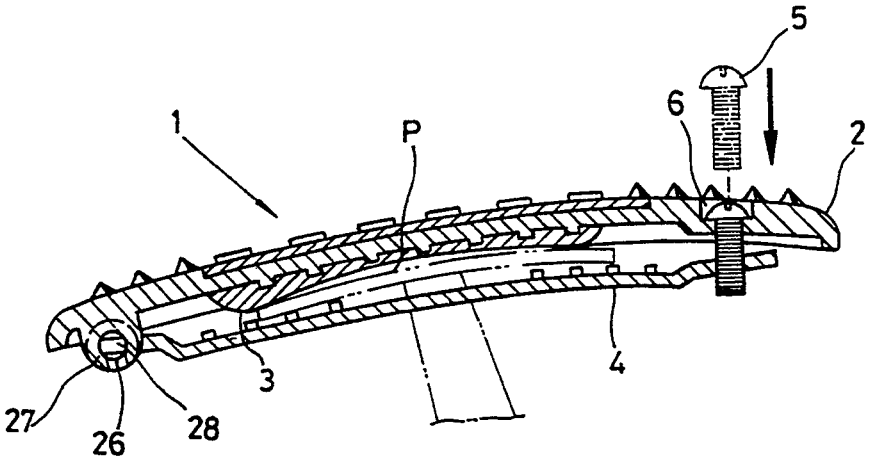
FIG. 4 is another example of the present invention.

FIG. 4 is another example of the present invention. As shown, one end (the rear end) of the upper pedal piece 2 has a hinge boss 27 forming a hinge hole 26 and the corresponding end of the lower supporter 4 has a hinge pin 28 such that the rear ends of the upper pedal piece 2 and the lower supporter 4 have a hinge connection.

This construction provides more convenience than the former in assembling.

Figure 5:
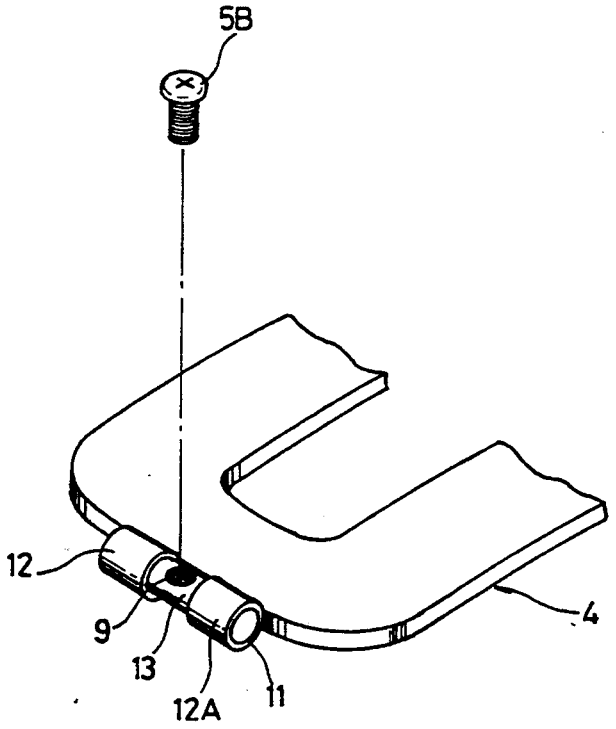
FIG. 5 is another example of the lower supporter of the present invention.

FIG. 5 is another example of FIG. 4. As shown, the rear end of the lower supporter 4 has two bosses 12, 12A having inserting holes 11. At the inserting hole 11 of the bosses 12, 12A, a shaft 13 having a screw hole 9 is connected.

In this embodiment, the bolt 5B is first screwed into the screw hole 9, and the bolts 5, 5A are inserted to the slots 8, 8A of the lower supporter 4 which combines the upper pedal piece 2 and the locking plate 10. Any other assembling order is similar to said explanation, therefore the detailed description will be omitted.

Figure 6:
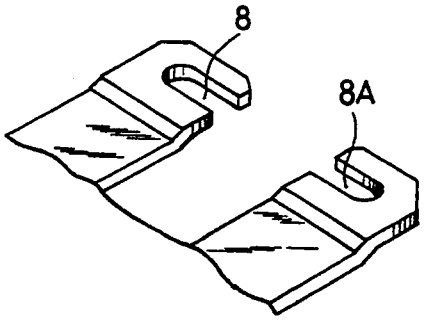
FIG. 6 to FIG. 8 are other examples assembling the upper pedal and the lower supporter of the present invention.
Figure 7:
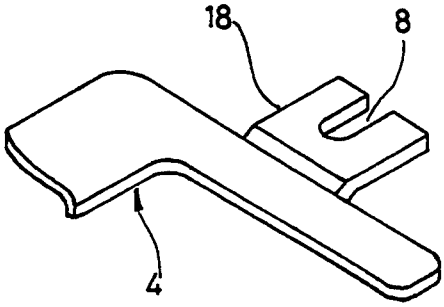
Figure 8:
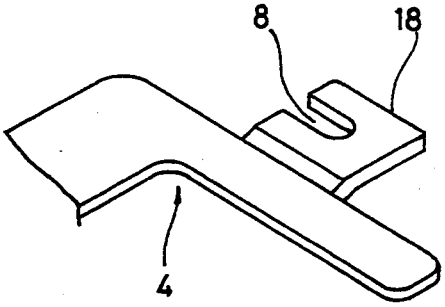

FIG. 6 to FIG. 8 show other forms of the front end of the lower supporter 4. In FIG. 6, two slots 8, 8A are formed facing the inside of the lower supporter 4, and in FIG. 7 the front end of the lower supporter 4 is attached to a piece 18 having slot 8 to form one body. FIG. 8 shows the slot 8 of the piece 18 is formed facing the left side of the drawing.

Figure 9:
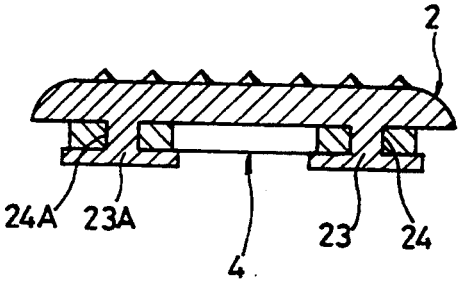
FIG. 9 is a front section view showing another example assembling the upper pedal and the lower pedal.

FIG. 9 is another embodiment of the upper pedal piece 2 and the lower supporter 4. In this embodiment, the upper pedal piece 2 is formed with extending portions 23, 23A which may be inserted to the slots of the lower supporter 4. In accordance with this embodiment, the locking plate 10 and the bolts 5, 5A can be eliminated.

Figure 10:
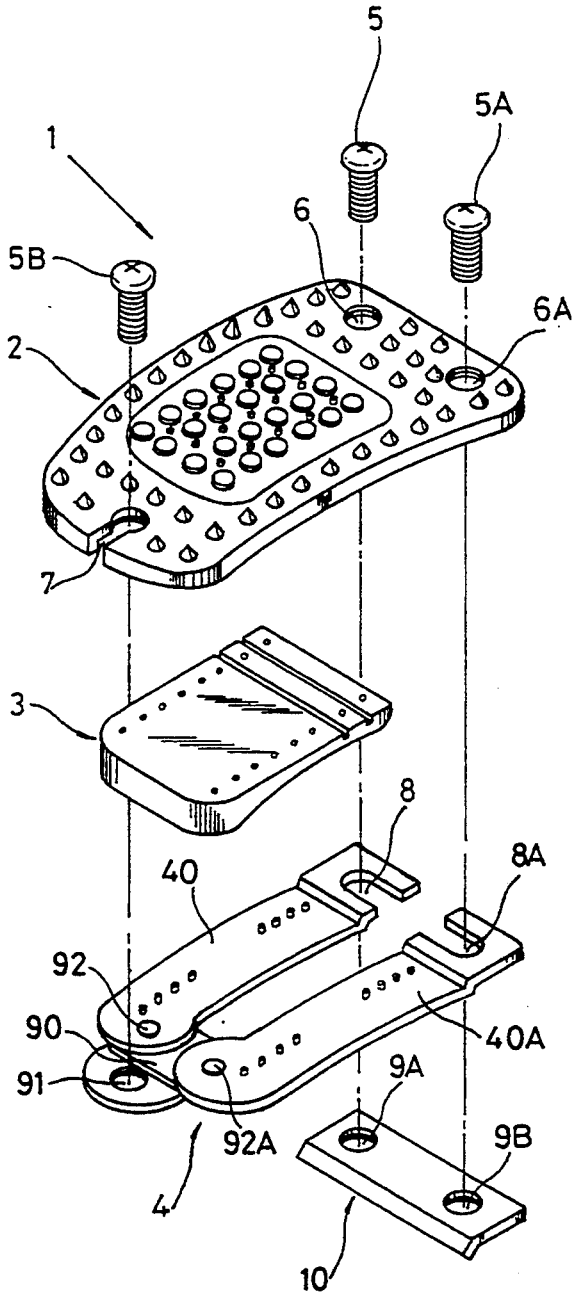
FIG. 10 to FIG. 17 are other examples in accordance with the present invention.

FIG. 10 is another embodiment of the lower supporter 4, in which the lower supporter 4 is composed of two rotating members 40, 40A, each being connected at one end with a connecting piece 90 by means of pins 92, 92A. The connecting piece 90 has a screw hole 91 for attachment with the open screw hole 7 of the upper pedal piece 2.

Figure 11:
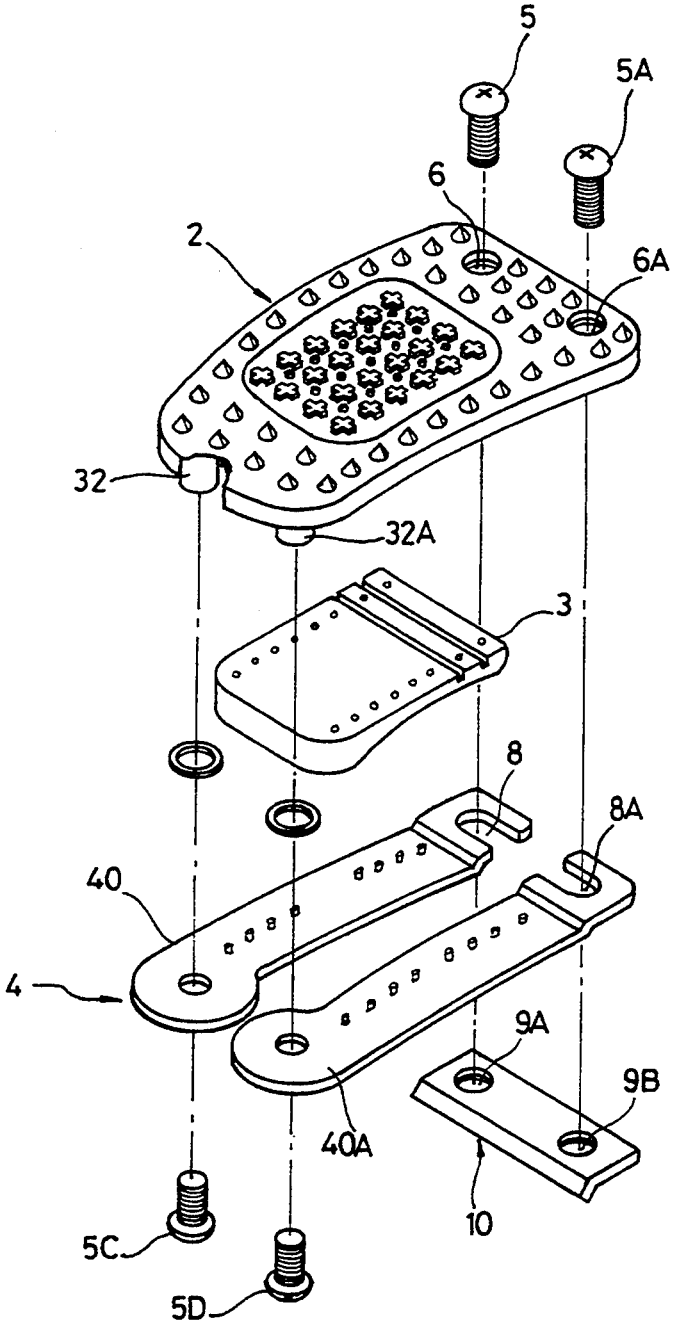

FIG. 11 is another embodiment of FIG. 10, in which the upper pedal piece 2 has bosses 32, 32A, and the two rotating members 40, 40A of the lower supporter 4 are not connected with any connecting piece 90 but directly assembled by bolts 5C, 5D.

Figure 12:
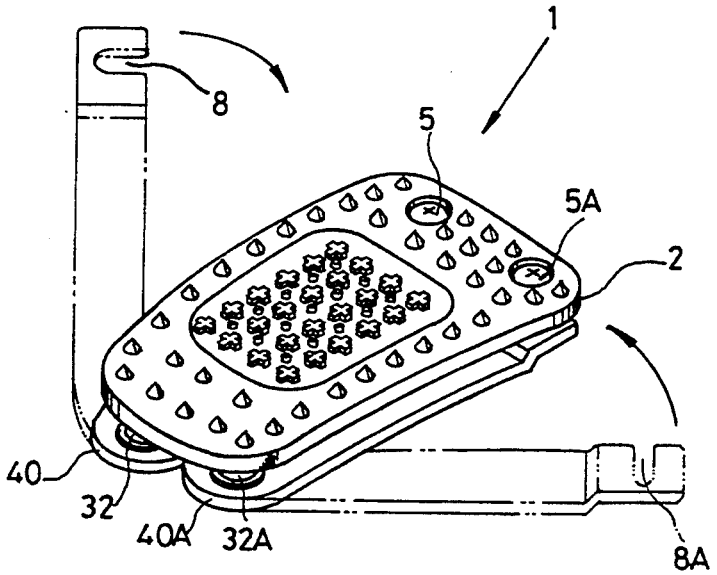
Figure 13:
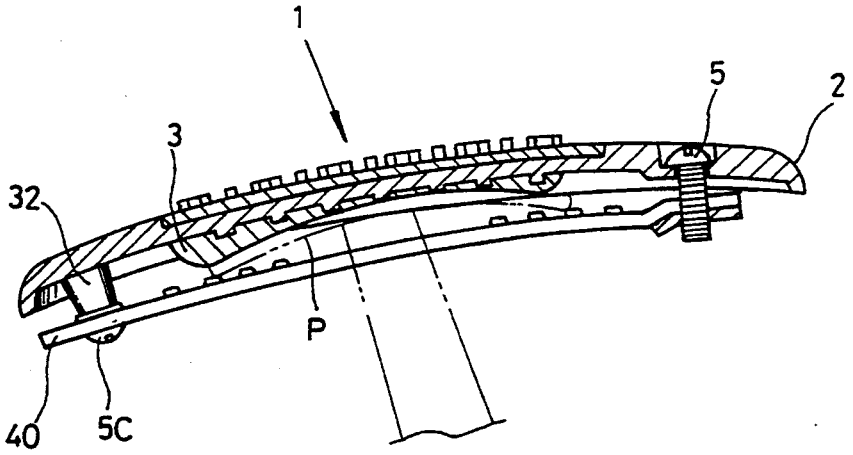

As shown in FIG. 12 and FIG. 13, when the present device is assembled after loosely assembling the upper pedal piece 2 and two rotating members 40, 40A by the bolts 5C, 5D, the rotating members 40, 40A may widen and be placed at the pedal P, then, by folding, rotating member 40, 40A may be aligned with the screw holes 6, 6A of the upper pedal piece 2, the slots 8, 8A of the lower supporter 4, and the screw holes 9A, 9B of the locking plate 10. Finally the bolts 5, 5A, 5C, 5D are screwed.

Figure 14:
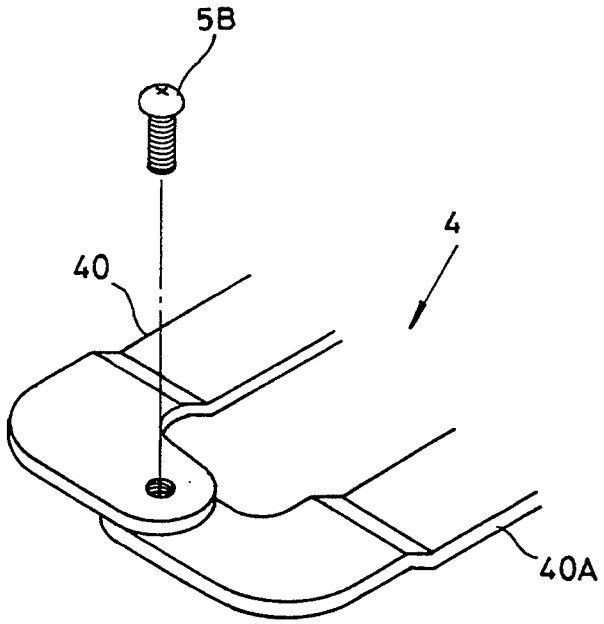

FIG. 14 is another embodiment of the rotating members 40, 40A, one end of each of the rotating members 40, 40A having a screw hole which may be aligned so as to make possible assembly by one bolt 5B.

Figure 15:
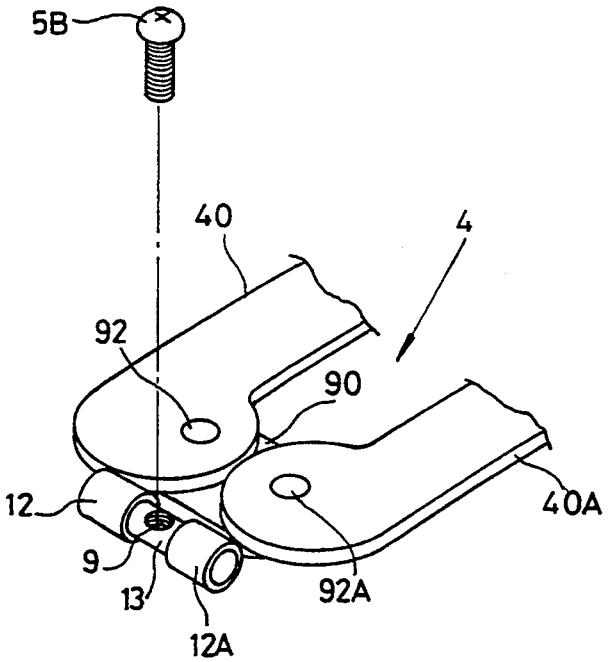

FIG. 15 is another embodiment in which the rotating members 40, 40A are rotatably connected by means of pins 92, 92A and a connecting piece 90 having a hinge connection via bosses 12, 12A and the shaft 13.

Figure 16:
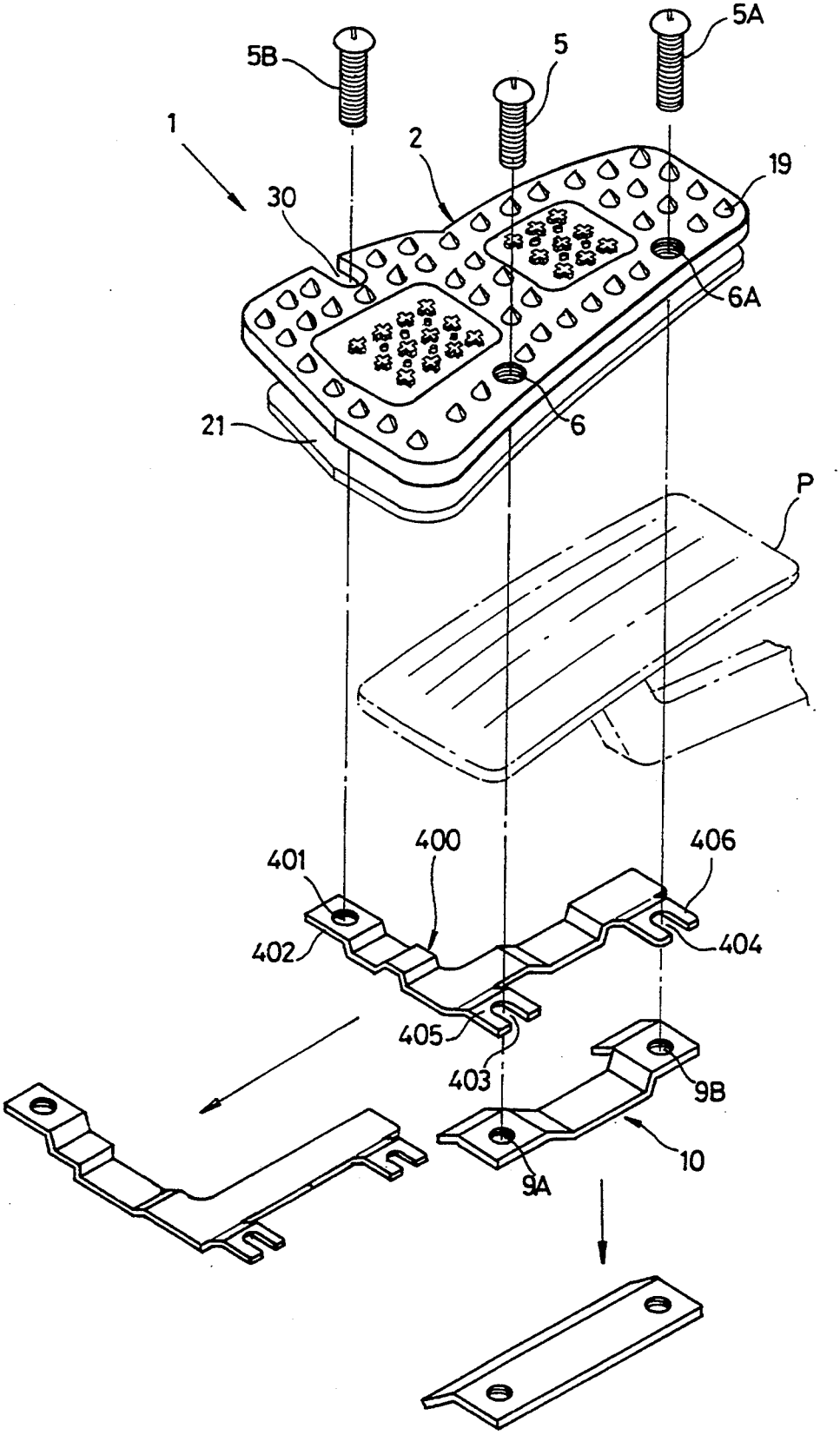
Figure 17:
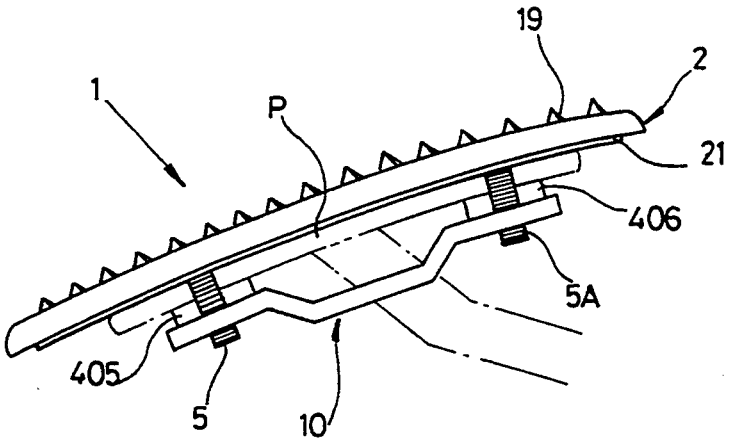
Figure 18:
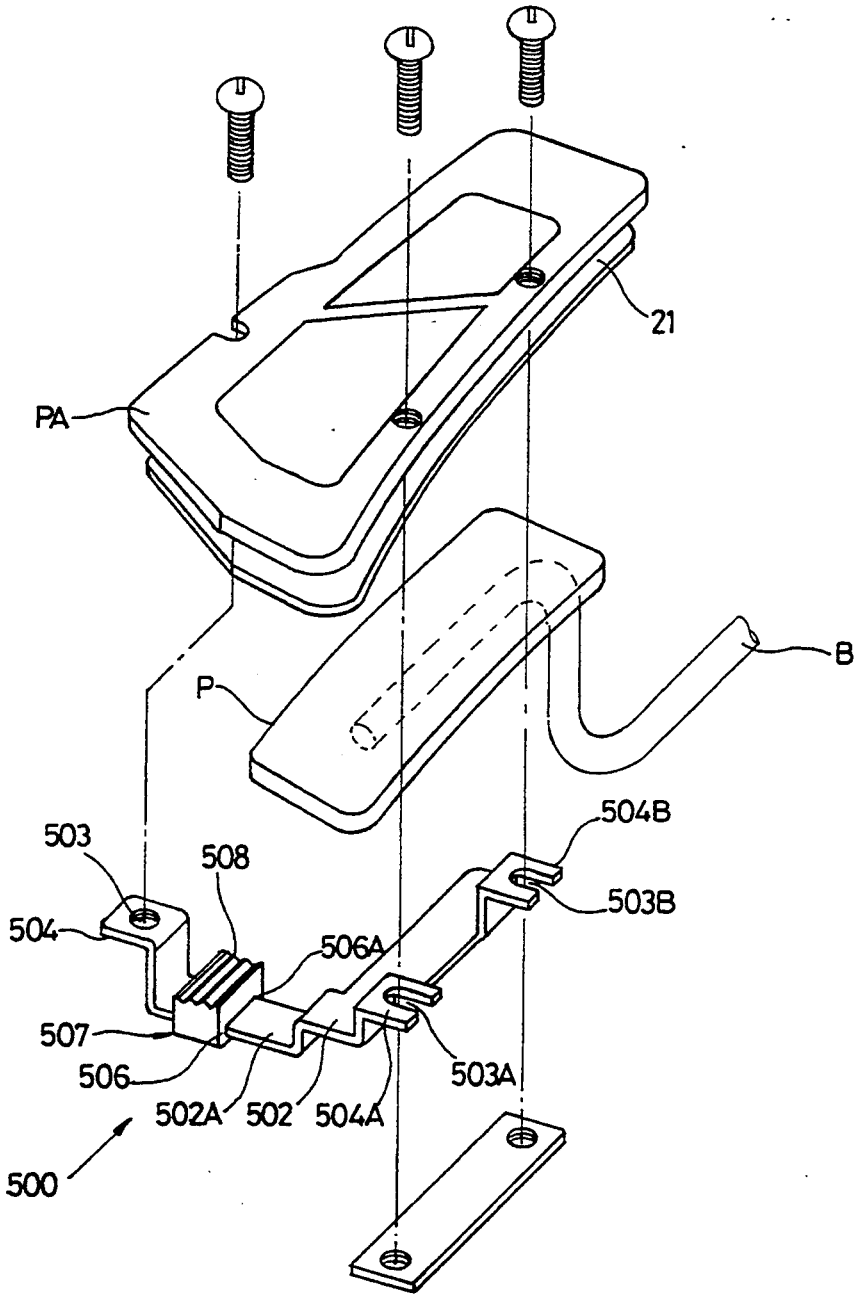
FIG. 18 to FIG. 21 are other examples which may be applied to an acceleration pedal of motorcycles.

FIG. 16 and FIG. 17 show another embodiment which may be applied to an acceleration pedal. In this embodiment, the upper pedal piece has two screw holes 6, 6A on one side and one open screw hole 30 on the other side. The corresponding lower supporter 400 is formed in an "L" shape which comprises three angled portions 402, 405, 406, said angled portions 402, 405, 406 having a screw hole 401 and two slots 403, 404. Under said lower supporter 400 an angled locking plate 10 is provided.

Alternative embodiments of the lower supporter 400 and the locking plate 10 are shown as indicated by arrows in FIG. 16, i.e. wherein one portion of the lower supporter 400 is flat and the locking plate 10 is entirely flat.

Assembly is possible as follows:

Through the screw holes 6, 6A of the upper pedal piece 2 bolts 5, 5A are partially screwed into the screw holes 9A, 9B of the locking plate 10, and through the screw hole 401 of the lower supporter 400 the bolt 5B is partially screwed, the bolts 5, 5A are inserted to slots 403, 404 of the lower supporter 400 which connects the upper pedal piece 2, the bolt 5B which is fixed in the screw hole 401 of the angled portion 402 is inserted into the open screw hole 30 of the upper pedal piece 2, and finally the bolts 5, 5A, 5B are tightly screwed.

FIG. 18 to FIG. 21 show another embodiment that may be applied to the acceleration pedal of a motorcycle having a connecting bar B.

In this case, a lower supporter 500 has a guide surface 502A, a sliding supporter 507 which may slide along said guide surface 502A, and a stepped portion 502. The sliding supporter 507 has an uneven upper surface 508 and two bridges 506, 506A.

Hereinafter, the assembling method will be explained.

Figure 19:
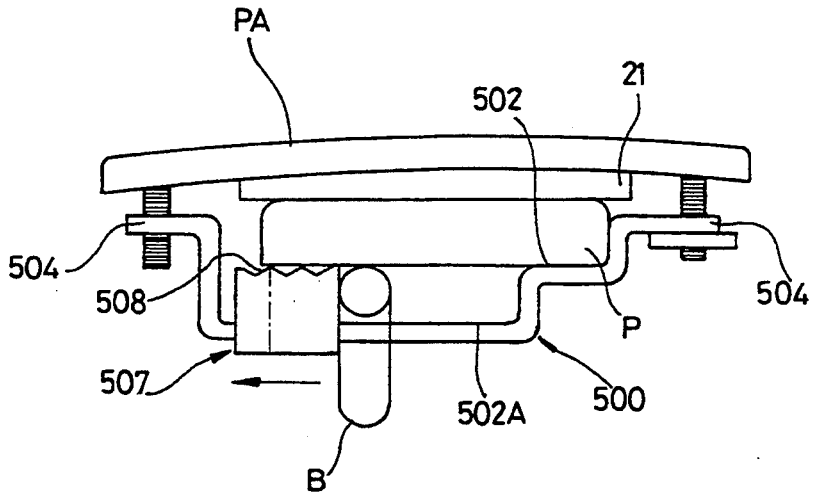

FIG. 19 is an example wherein the width of the acceleration pedal is wide and the connecting bar B is attached at the left side. In this case, the sliding supporter 507 may slide toward the left side and the right side of the acceleration of the motorcycle is supported on the stepped portion 502, and the bolt is screwed.

Figure 20:
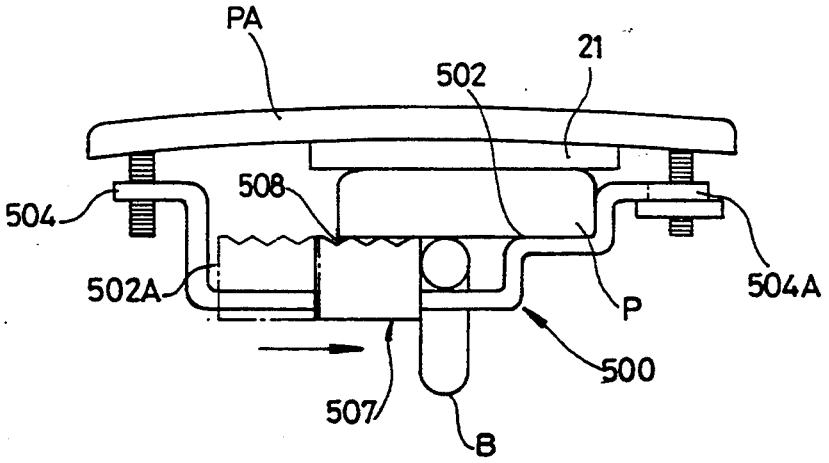

FIG. 20 is an example in which the width of the acceleration pedal is narrow and the connecting bar B is located toward the right side In this case, the sliding supporter 507 may slide to the right side and the bolt is screwed.

Figure 21:
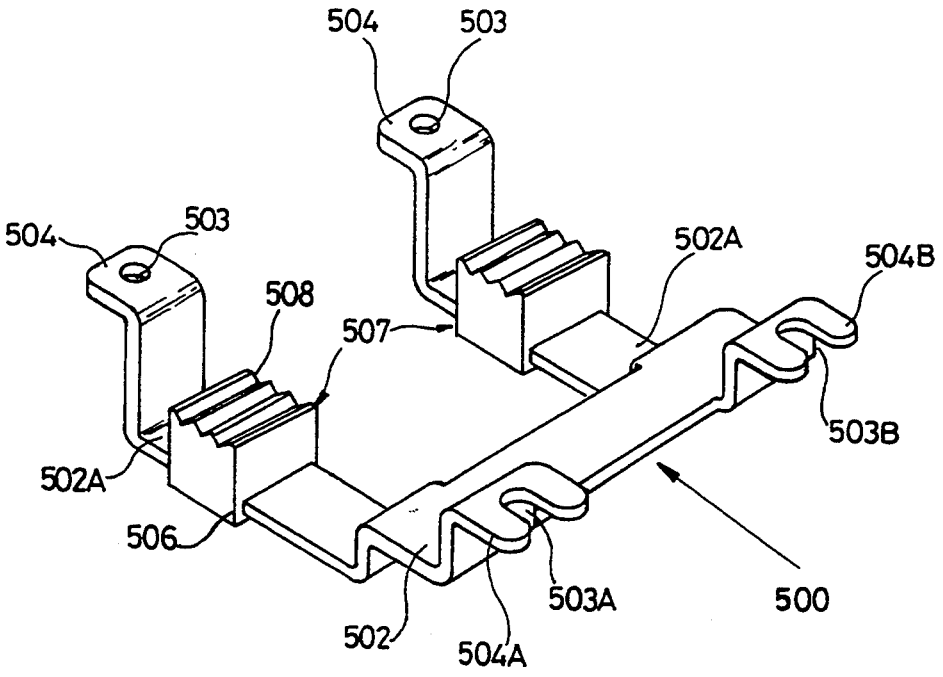

FIG. 21 is another example of the lower supporter 500 wherein there are two sliding supporters 507 and the guide surfaces 502A, thereby, the supporting and the locking are more surely kept.

Figure 22:
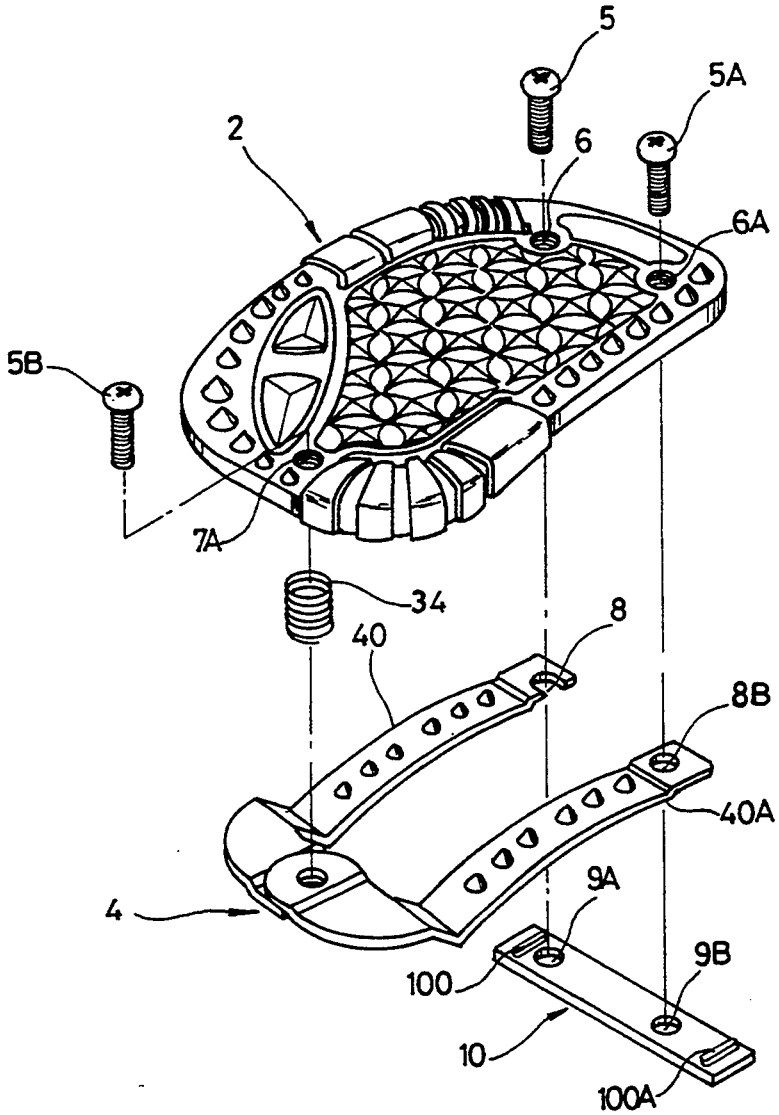
FIG. 22 and FIG. 23 are other examples of FIG. 1 and FIG. 2.
Figure 23:
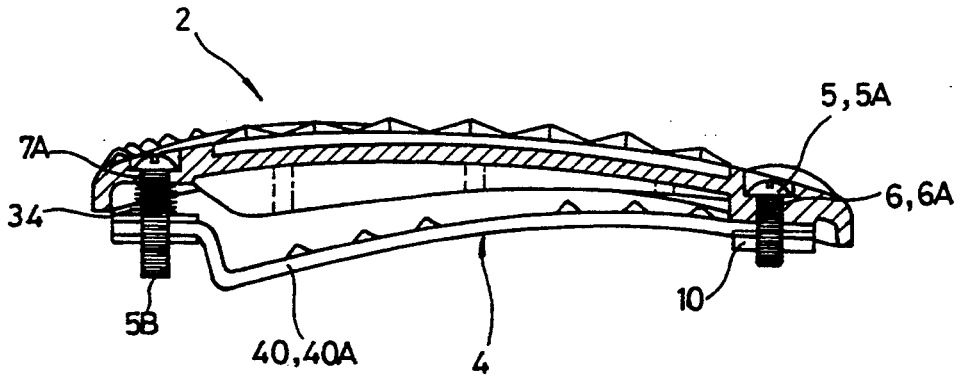

FIG. 22 and FIG. 23 are other examples of FIG. 1 and FIG. 2.

As shown, the most characteristic parts are that the upper pedal piece has three screw holes 6, 6A, 7A, the rotating member 40A of the lower supporter 4 has a screw hole 8B at its front end, and the locking plate 10 has a protrusion 100, 100A which prevents the rotating member from widening out. A spring 34 is provided to the bolt 5B so that the quaking by unscrewing is prevented.

As explained from said examples, in accordance with the present invention, it is very convenient to assemble the supplementary device to the pedal and the assembly is kept more tightly.

While the invention has been illustrated and described with several embodiments, it is recognized that variations and changes can be made without departing from the scope and spirit of the invention.

What is claimed:

1. A supplementary device for vehicle pedal comprising:

an upper pedal piece having an open hole and a screw hole, said upper pedal piece being installed on the pedal;

a lower supporter having a slot in which a bolt may be inserted to connect said upper pedal piece and said lower supporter, and a screw hole;

said lower supporter including two rotating members, each being connected by a pin with a connecting piece having a screw hole; and a locking plate for fixing said upper pedal piece and said lower supporter.

2. A supplementary device for vehicle pedal according to claim 1, wherein said upper pedal piece has a boss, said lower supporter is formed with two rotating members having screw holes, such that by screwing from the bottom of said lower supporter, said upper pedal piece and said lower supporter may be assembled.

3. A supplementary device for vehicle pedal according to claim 1, wherein the connecting piece has a boss and a shaft formed with a screw hole in which a bolt may be inserted from the upper pedal piece.

4. A supplementary device for vehicle pedal according to claim 1, wherein said upper pedal piece has three screw holes, said lower supporter is formed with two rotating members, in which one rotating member has a screw hole, and said locking plate includes a protrusion.

5. A supplementary device for vehicle pedal comprising:

an upper pedal piece having an open hole and a screw hole, said upper pedal piece being installed on the pedal;

a lower supporter having a slot in which a bolt may be inserted to connect said upper pedal piece and said lower supporter, and a screw hole;

said lower supporter including two rotating members each having a screw hole aligned so that they may be attached by one bolt; and a locking plate for fixing said upper pedal and said lower supporter.

* * * * *